United States Patent [19]

Spross et al.

[11] Patent Number: 5,016,942

[45] Date of Patent: May 21, 1991

[54] ANCHOR BORING UNIT

[75] Inventors: Erhard Spross, Neunkirch; Hans-Rudolf Ruttimann, Rafz, both of Switzerland

[73] Assignee: Sony Corporation, Tokyo, Japan

[21] Appl. No.: 500,391

[22] Filed: Mar. 28, 1990

[30] Foreign Application Priority Data

Apr. 7, 1989 [CH] Switzerland ..... 1319/89-7

[51] Int. Cl.[5] ..... E21C 11/02; E21D 20/00

[52] U.S. Cl. ..... 299/33; 173/43

[58] Field of Search ..... 299/11, 33, 75, 76; 405/260, 259; 173/38, 39, 42, 43, 46, 44

[56] References Cited

U.S. PATENT DOCUMENTS

| | | | |
|---|---|---|---|
| 3,712,385 | 1/1973 | Hunt | 173/43 |
| 4,398,850 | 8/1983 | Talvensaari | 173/38 X |
| 4,610,573 | 9/1986 | Paürat et al. | 299/33 X |
| 4,740,037 | 4/1988 | Eager et al. | 299/33 X |
| 4,758,049 | 7/1988 | Wernigg et al. | 299/33 |
| 4,799,556 | 1/1989 | Foster et al. | 173/43 |

FOREIGN PATENT DOCUMENTS

| | | |
|---|---|---|
| 0149056 | 11/1984 | European Pat. Off. . |
| 2028693 | 3/1980 | United Kingdom . |

*Primary Examiner*—Bruce M. Kisliuk
*Assistant Examiner*—David J. Bagnell
*Attorney, Agent, or Firm*—Lewis H. Eslinger

[57] ABSTRACT

An anchor boring unit includes a base plate attached to a loading apron of a section advance machine, with a square tube swivelling around a vertical axis and movable by a hydraulic cylinder attached to the base plate. Another square tube is telescoped in the first square tube and a carrier attached to the upper end of tube can be lifted along the axis by another hydraulic cylinder. An arm attached to the carrier is movable by a third hydraulic cylinder around the axis and a plate attached to the arm is movable by the second hydraulic cylinder around another axis perpendicular to the first axis and to a boring axis. The anchor boring unit is capable of telescoping with two other cylinders for moving a mount in relation to the base plate and a boring machine in relation to the mount along a boring axis for seating roof anchors regardless of the section height and for seating wall anchors using the same boring unit as for the roof anchors.

7 Claims, 5 Drawing Sheets

ANCHOR BORING UNIT

BACKGROUND OF THE INVENTION

1. Field of the Invention

This invention relates generally to an anchor boring unit to be attached to a section advance machine using in mining operations.

2. Description of the Background

Advance machines are used in section advances in underground working, for example, in coal mining. Mountain anchors or rock bolts or rock anchors are placed to secure the roof of the tunnel. This roof securing should take place as close as possible to the position front of the advance.

The mounting of anchor boring units directly on the advance machine is already known, and such an anchor boring unit is described in German Patent DE-PS 31 08 877. This document shows an advance machine in which boring devices are movable in a peripheral direction and are capable of swivelling or moving longitudinally by being mounted on a yoke. It is thereby possible to seat the rock anchors close to the position front of the advance. Nevertheless, it is not possible to alter the section profile of the advance with this system, because the boring devices have a relatively small thrust and, more importantly, the yoke requires a minimum height of the section that is considerably greater than what would normally be necessary for the advance machine itself. This is especially disadvantageous in the mining of ore or coal, because it is not possible to adapt the section height to the deposit thickness, and consequently either much barren rock must be mined, or it is not possible to utilize all of the deposit thickness that is present.

In addition, movement of the rock anchor boring units to the side is limited by the mining machine itself. Thus, if it is also necessary to secure the vertical side walls by anchors, a separate carrier with a second yoke on which other rock anchor boring devices are movably attached must be pulled along by the mining machine, when following the proposal according to DE-PS 31 08 877. On this second yoke, the outermost boring device can in all cases be run deeper downward, and the wall can thereby also be assured, however, this securing of the wall takes place at quite a distance from the position front.

Another rock anchor boring unit attached to a section advance machine is shown in German Patent DE-PS 33 34 975, in which it is only possible to seat two anchors into the roof. These two anchors can only be located to the left and right of the advance machine in all cases, and the anchors are not close to the position front.

An anchor boring unit that is attached to a movable cutting unit is shown in German Patent DE-PS 34 28 358. With that apparatus, it is only possible to insert anchors into the roof and, moreover, the cutting process necessarily halts during the anchor placement.

German Patent DE-OS 35 23 035 describes another section advance machine with installed anchor boring units, however, once again only the roof can be anchored.

In German Patent DE-OS 36 34 502, assigned to the assignee hereof, an anchor boring unit is described that is designed to operate telescopically and therefore permits a better adaptation of the boring unit height to the deposit thickness than the anchor boring units hitherto described. The unit according to DE-OS 36 34 502 is somewhat movable around a horizontal axis, so that it is possible to seat several anchors in the roof next to each other with the same unit.

OBJECTS AND SUMMARY OF THE INVENTION

Accordingly, it is an object of the present invention to provide an anchor boring unit mounted on a section advance machine that can eliminate the above-noted defects inherent in the prior art.

Another object of the present invention is to provide an anchor boring unit, whereby it is possible to seat anchors close to the position front in the wall of the section advance.

According to an aspect of the present invention an anchor boring unit is mounted on a section advance machine by means of a pivot mechanism that is arranged to permit anchor bore holes to be bored in both the roof and the wall of a section advance.

The above and other objects, features, and advantages of the present invention will become more apparent from the following description when read in conjunction with the drawings.

DETAILED DESCRIPTION OF PREFERRED EMBODIMENTS

Figure 1:
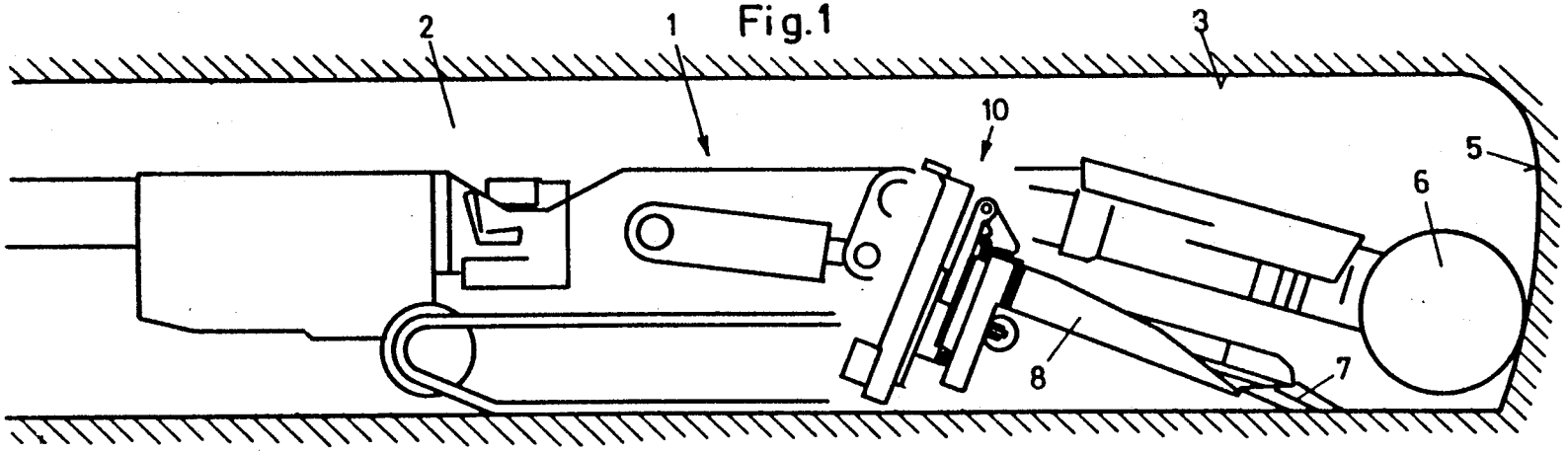
FIG. 1 is a side elevational view of a cutting machine with an anchor boring unit mounted thereon, according to an embodiment of the present invention.
Figure 2:
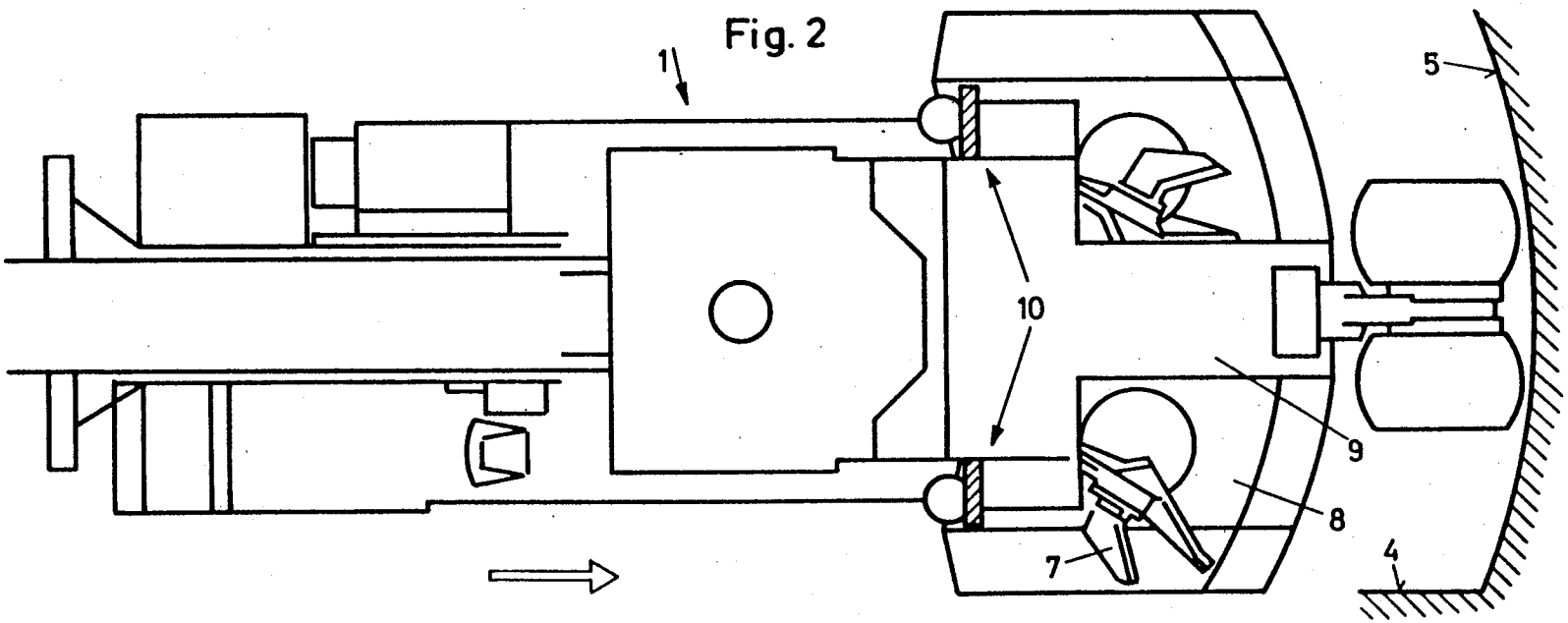
FIG. 2 is a top plan view of the machine shown in FIG. 1.

A section advance or cutting machine is represented generally at 1 in FIGS. 1 and 2 being positioned in an advance section 2 that is formed with a roof 3, two side walls 4, only one of which is shown, and a position front 5. Machine 1 is moved forward in steps and after each step with cutting tool 6 the mined material, for example, coal, is removed from position front 5. The mined material is shoved by two slip hooks 7 onto a loading apron 8 and then against a central conveyor belt 9, whereby it is transported to the rear of the machine. Anchor boring units 10 constructed according to an embodiment of the invention operate to seat rock anchors into both roof 3 and either wall 4 and are attached at the rear end of loading apron 8 on both sides of machine 1, as shown in FIG. 2. Anchor boring unit 10 is represented in greater detail in FIGS. 3 to 6.

Figure 3:
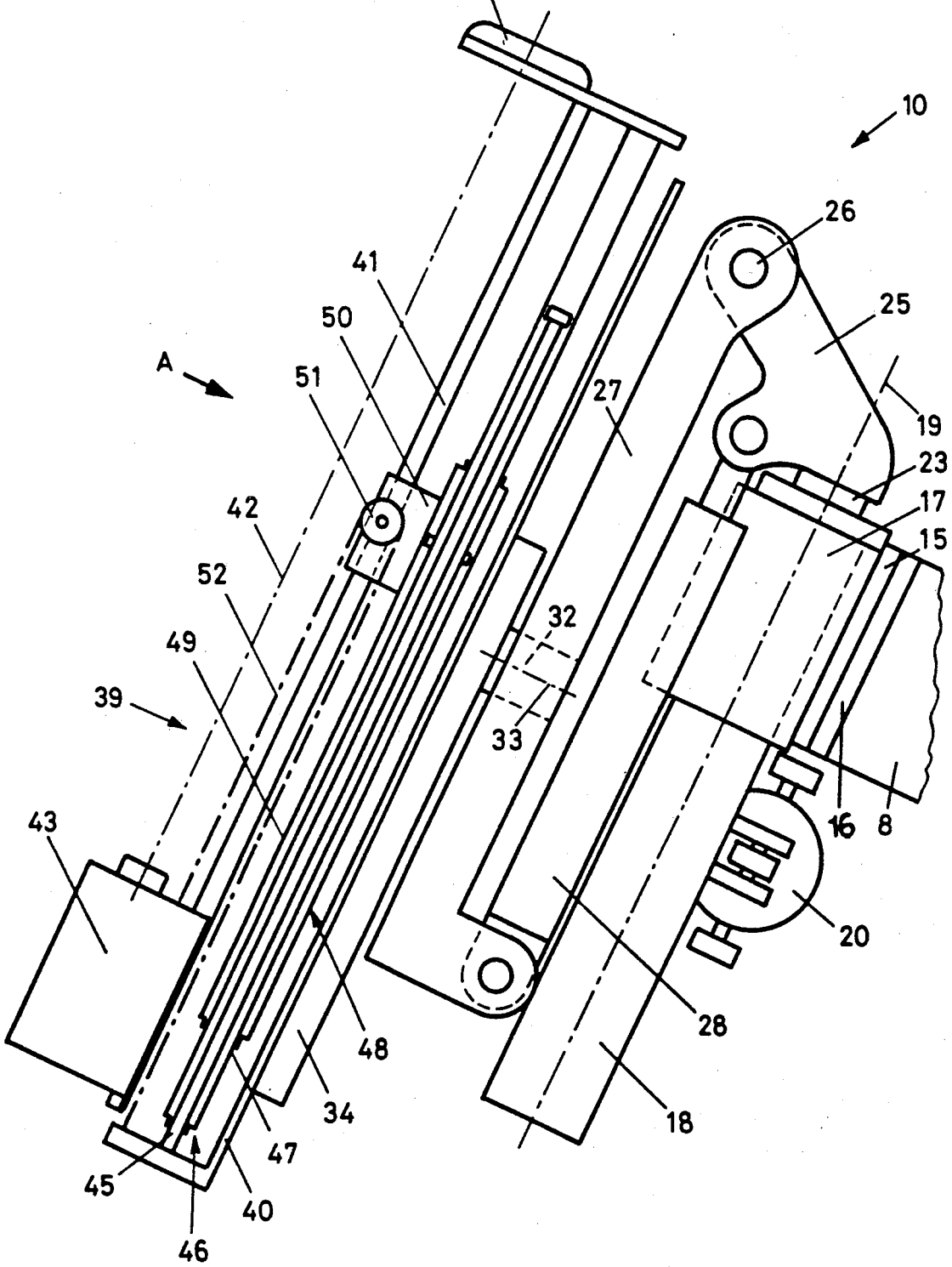
FIG. 3 is a side elevational view of the anchor boring unit of FIG. 1 shown on an enlarged scale.
Figure 4:
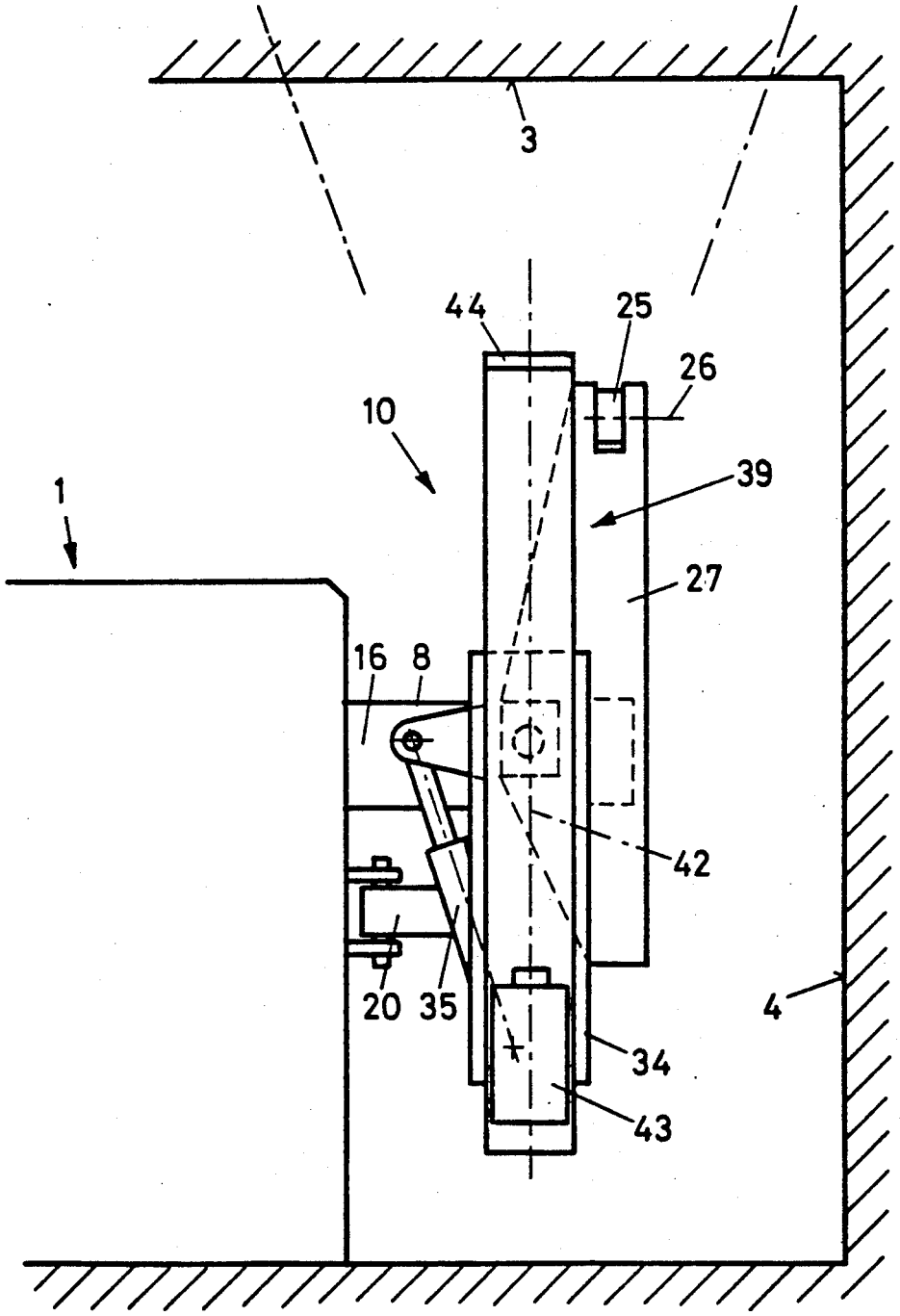
FIG. 4 is an elevational view of the boring unit of the present invention looking in from direction A in FIG. 3.
Figure 5:
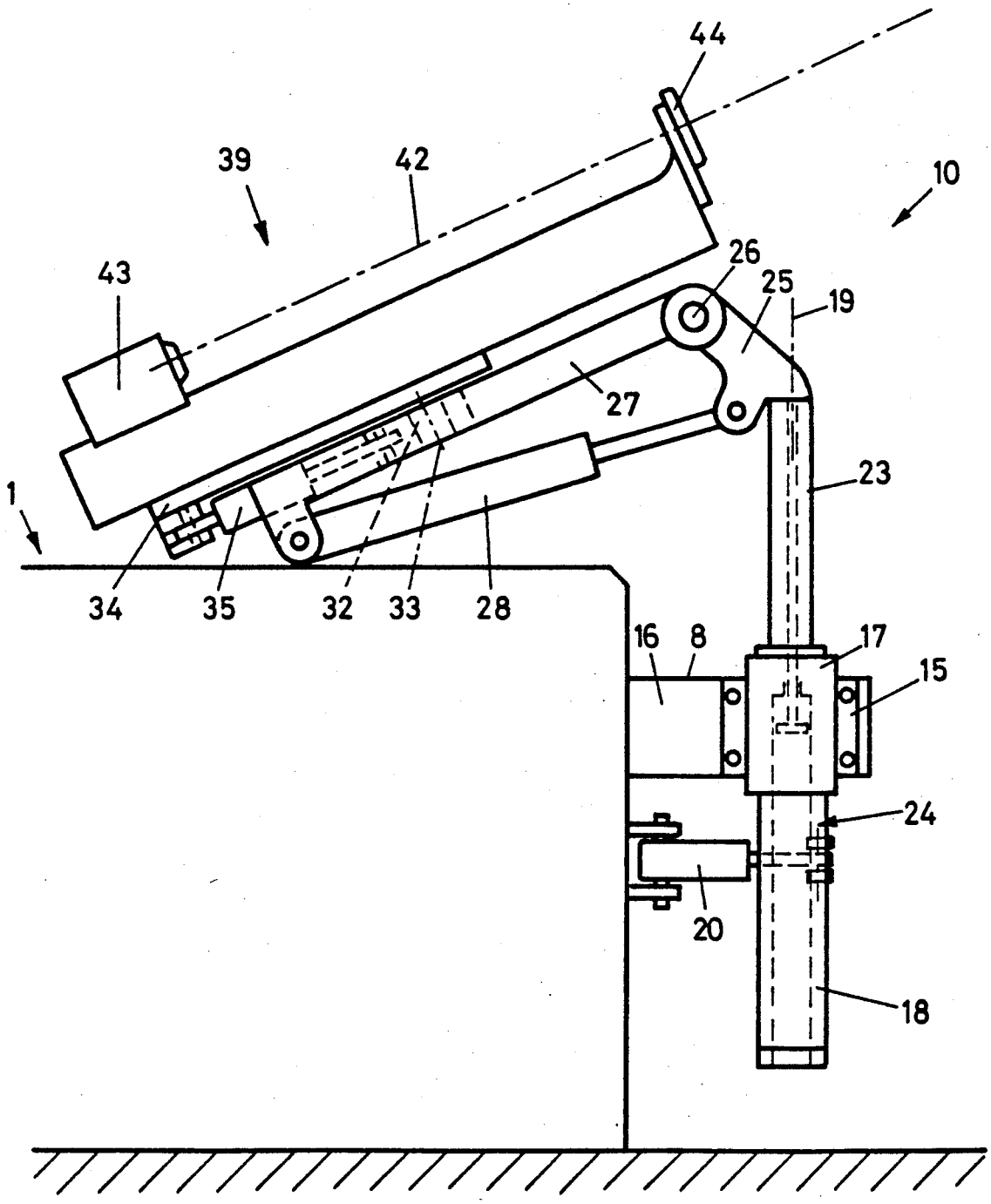
FIG. 5 is an elevational view as in FIG. 4 in an operating condition.
Figure 6:
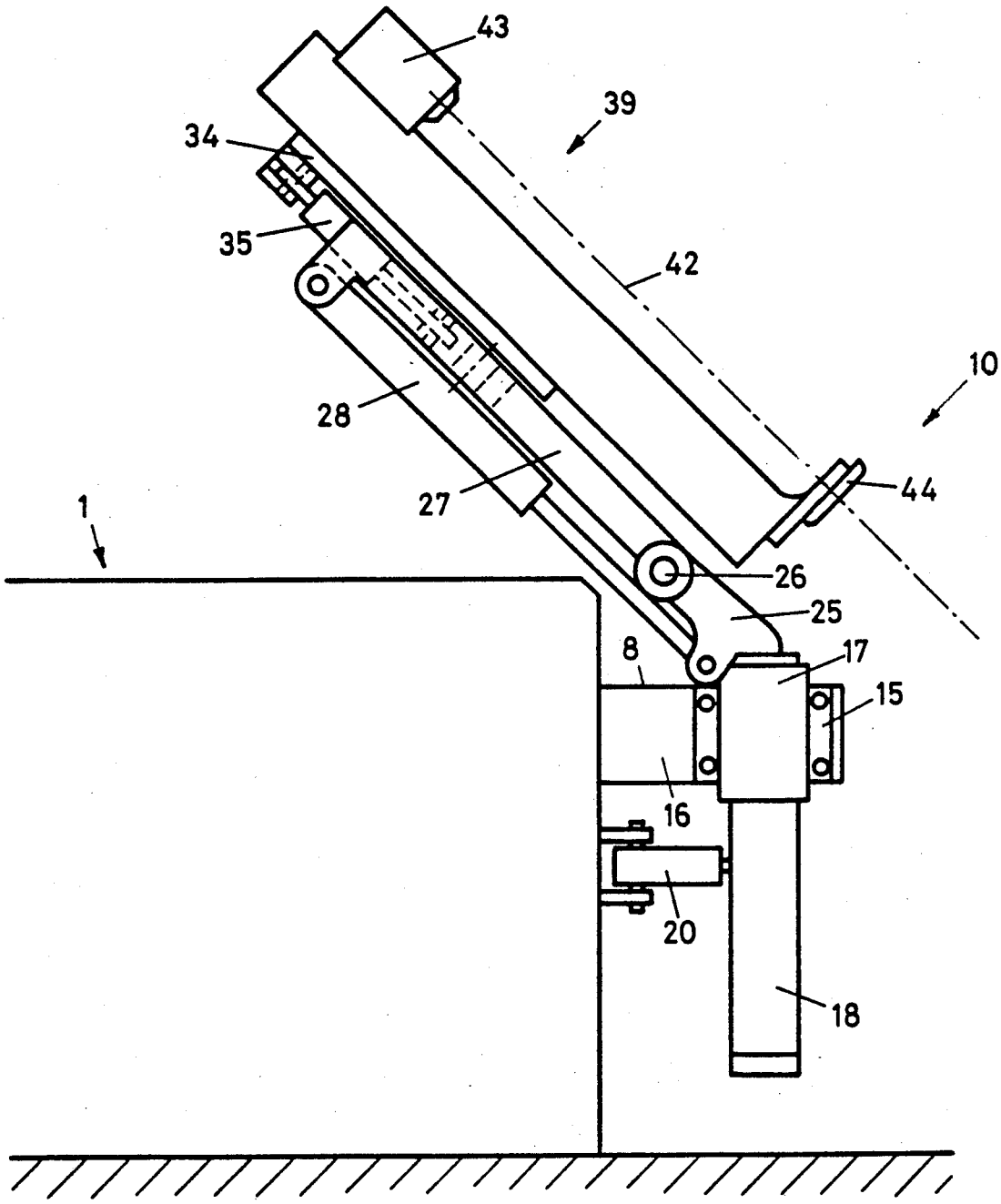
FIG. 6 is an elevational view similar to FIG. 5 in another condition of operation.

FIG. 3 is a side view of anchor boring unit 10 shown in FIG. 1 in an enlarged scale, in which a base plate 15 of the unit is firmly bolted to the rear front side 16 of loading apron 8 and inclined slightly to the vertical. A case or housing 17 is welded to base plate 15 and contains a square tube 18 that is attached to pivot around an axis 19 that extends generally in a height direction. Square tube 18 is not movable axially, however, tube 18 can be moved around axis 19 by a hydraulic cylinder unit 20 for somewhat more than 90° from the basic position as represented in FIGS. 3 and 4 into the position shown in FIGS. 5 and 6 and somewhat beyond that.

Another square tube 23, also movable along axis 19, is placed in square tube 18. Tubes 18 and 23 are connected with each other but are incapable of mutual rotation because of the dimensions and the square form. A second cylinder unit 24, shown in phantom in FIG. 5, controls the thrust of tube 23 out of tube 18. A carrier link 25 is firmly welded at a nose portion to the upper end of pipe 23. An arm 27 is movable around pivot axis 26, shown in FIG. 4, perpendicularly relative to axis 19 and is movably attached to carrier link 25. Arm 27 can be swivelled or pivoted in relation to carrier link 25 by means of a third hydraulic cylinder unit 28 connected between link 25 and a distal end of hydraulic cylinder 28.

A pin 32 is mounted in arm 27 to be movable around an axis 33 that is perpendicular relative to axis 26 and to the longitudinal extension of arm 27. Pin 32 is welded to a mounting plate 34 that can pivot in both directions around axis 33 in relation to arm 27 by means of another hydraulic cylinder unit 35 from the basic position represented in FIG. 4. An anchor drilling device 39 that is shown only generally is bolted onto mounting plate 34. Drilling device 39 is preferably constructed according to DE-OS 36 34 502 and includes a carrier 40 bolted to plate 34. A drilling unit mount 41 is movably arranged on carrier 40 parallel to drilling axis 41 by guide elements (not shown). A drilling machine 43 is movable along a drilling axis 42 by means of a mount 41. Mount 41 carries drill bar guide 44 at its front end.

FIG. 3 shows a piston rod 45 of another hydraulic cylinder unit 46 that is arranged parallel to boring axis 42 and is rigidly connected to carrier 40. The outer cylinder 47 of unit 46 is rigidly connected with mount 41 and forms the piston rod of another, coaxial, hydraulic cylinder unit 48. A carriage 50 is movable parallel to boring axis 42 along mount 41 and is rigidly attached to the cylinder portion 49 of hydraulic cylinder unit 48. Carriage 50 carries a guide roller 51, which has wound there around chain or cable 52. One end of cable 52 is attached to boring machine 43 and the other end to carrier 40. Provision is made at the thrust of boring machine 43 for withdrawal of boring machine 43 (not represented). By means of these coaxially arranged hydraulic cylinders, boring device 39 can thus be telescoped parallel to boring axis 42.

Anchor boring unit 10 as described above functions as follows in operation. In the basic position as shown in FIGS. 1 to 4, the drill or boring bar guide 44 does not exceed the mining machine 1 in height, so that the section height being mined is limited only by the height of mining machine 1. By extending out hydraulic cylinder unit 46 and/or unit 24, shown in FIG. 5, the pilot or guide 44 for the boring bar can be run out a large amount equal to the height of roof 3. Thus, in spite of varying section heights, it is thereby possible to bore deep holes and seat long anchors. The rock anchors ca be seated over a broad range in roof 3 and obliquely to the advance direction by swivelling drilling device 39 by means of hydraulic cylinder unit 35. If a change in advance direction is necessary, for example, if it is necessary to place a deflection sheet obliquely to the advance direction, hydraulic cylinder unit 28 is activated.

When rock anchors are to be seated in walls 4, arm 27 is swivelled to an approximately horizontal position by means of hydraulic cylinder unit 28, and carrier link 25 is driven by means of unit 24 and is rotated 90° by means of unit 20. It is then possible to seat the wall anchor in the same way as the roof anchor. Practically, the entire height of wall 4 can be covered by inclining arm 27 using unit 28 and, if necessary, introducing unit 24 (FIG. 5), in spite of the narrow swivelling angle of arm 27 limited by the structural conditions. If the borehole is to be drilled further in the advance direction in front or behind, unit 35 and/or unit 20 is additionally activated.

The boring unit described is very compactly designed, so that it requires only very little space on mining machine 1 and, in particular, it does not increase the minimum cross-section presented by machine 1. An economical use of machine 1 thereby becomes possible, since it will not be necessary to mine barren rock in case of a small deposit thickness. On the other hand, it is also possible to bridge large section heights with the same unit 10 and thereby seat long anchors because of the double telescope effect. Because it is also possible to seat anchors in the walls with the same unit, the unit can have optimally equalized loads, and a separate anchor seating device behind the mining machine and the additional operating persons necessary for the additional machine are superfluous. Moreover, anchoring the walls takes place a short distance behind the position front, which substantially increases safety.

If the mining machine is well braced, it is also possible to begin anchoring during the milling process. Work with anchors otherwise waits until the milling process has ended. Enough time remains during the loading and transporting away of the milled material to drill several anchor holes and seat anchors with the boring unit according to the invention into both the roof and the wall.

If the space conditions so permit, it is possible to mount an automatic anchor boring and seating device according to DE-OS 37 35 388 on plate 34 instead of boring device 39. This can further facilitate the anchor seating process.

The above description is given o a single preferred embodiment of the invention, but it will be apparent that many modifications and variations could be effected by one skilled in the art without departing form the spirit or scope of the novel concepts of the invention, which should be determined by the appended claims.

What is claimed is:

1. An anchor boring unit for a section advance machine, including a base plate attached to the machine, a mount, a drilling machine on the mount movable along a boring axis, a motor for moving the drilling machine on the mount along the boring axis, as well as a swivel mechanism to swivel the mount relative to the base plate, characterized in that the swivel mechanism includes means for swivelling the mount to bore boreholes with the drilling machine unit in both a roof and also in a wall, wherein the swivel mechanism includes a first carrier pivotable around a first axis and movable in a height direction in relation to the base plate and a second carrier articulated movably at a second axis transversely to the first axis at the first carrier, and to which the mount is attached, and a second motor to swivel the first carrier around the first axis relative to the base plate, a third motor to move the first carrier in the height direction relative to the base plate, and a fourth motor to shift the second carrier around the second axis relative to the first carrier.

2. An anchor boring unit in accordance with claim 1, wherein the second carrier is attached movably on an arm movable around the second axis and activated by the fourth motor around a third axis arranged obliquely to the second axis and the boring axis and which is movable in relation to the arm by a fifth motor.

3. An anchor boring unit in accordance with claims 1 or 2, characterized in that the mount is additionally movable parallel to the boring axis relative to the second carrier, and a sixth motor moves the mount relative to the second carrier.

4. An anchor boring unit in accordance with one of claims 1 or 2, characterized in that the at least one of the first, second, third, fourth, and fifth motors are hydraulic cylinder units.

5. An anchor boring unit in accordance with claim 3, chracterized in that at leat one of the first, second, third, fourth, and fifth motors are hydraulic cylinder units.

6. An anchor boring unit in accordance with claim 3, characterized in that the first carrier is attached to a free end of a first tube having a polygonal outside and a round inside, and in that the first tube is telescopically movable in a second tube having a polygonal outside and a round inside, which is attached to the base plate to pivot around the first axis.

7. An anchor boring unit in accordance with one of claims 1 or 2, characterized in that the first carrier is attached to a free end of a first tube having a polygonal outside and a round inside, and in that the first tube is telescopically movable into a second tube having a polygonal outside and round inside, which is attached to the base plate to pivot around the first axis.

* * * * *

UNITED STATES PATENT AND TRADEMARK OFFICE

CERTIFICATE OF CORRECTION

PATENT NO. : 5,016,942

DATED : May 21, 1991

INVENTOR(S) : Erhard Spross and Hans-Rudolf Ruttimann

It is certified that error appears in the above-identified patent and that said Letters Patent is hereby corrected as shown below:

On the title page, Item [73] should read --

[73] Assignee: SIG SCHWEIZERISCHE INDUSTRIE-GESELLSCHAFT
Rheinfall, Switzerland --

Signed and Sealed this

Twentieth Day of October, 1992

*Attest:*

DOUGLAS B. COMER

*Attesting Officer*

*Acting Commissioner of Patents and Trademarks*